United States Patent [19]

Streibig et al.

[11] Patent Number: 4,646,907

[45] Date of Patent: Mar. 3, 1987

[54] COVER ARRANGEMENT FOR COVERING THE BALUSTRADE SILL OF A TRANSPORTATION APPARATUS, SUCH AS AN ESCALATOR OR MOVING WALKWAY

[75] Inventors: Kurt Streibig; Gerhart Buelke, both of Vienna, Austria

[73] Assignee: Inventio AG, Hergiswil, Switzerland

[21] Appl. No.: 760,063

[22] Filed: Jul. 29, 1985

[30] Foreign Application Priority Data

Aug. 10, 1984 [CH] Switzerland ..... 03843/84

[51] Int. Cl.[4] ..... B66B 23/22

[52] U.S. Cl. ..... 198/335

[58] Field of Search ..... 198/335, 337, 338

[56] References Cited

U.S. PATENT DOCUMENTS 3,321,059 5/1967 Kroepel ..... 198/335
3,989,133 11/1976 Courson et al. ..... 198/335
3,991,877 11/1976 Kraft et al. ..... 198/335

FOREIGN PATENT DOCUMENTS 2467813 10/1980 France .
2110625 6/1983 United Kingdom .

*Primary Examiner*—L. J. Paperner
*Assistant Examiner*—Lyle Kimms
*Attorney, Agent, or Firm*—Werner W. Kleeman

[57] ABSTRACT

The cover arrangement for covering the balustrade sill or base of a transportion apparatus, such as an escalator of moving walkway equipped with a self-supporting vertically disposed balustrade carrier is elastically fixed to the bottom or sub-structure of the balustrade sill or base by means of pairwise arranged, self-adhesive interlocking strips or bands. For this type of fixing, neither screws or bolts nor welding work is required to be performed upon the cover arrangement, so that no screw or bolt heads are visible and there can be used for the covers or panels of the cover arrangement, without any additional expenditure, the most varied materials and surface properties. Each of the cover arrangements, which are divided into an inner cover or panel and an outer cover or panel, can have their individual covers or panels removed, for maintenance purposes or otherwise, independently of the other cover arrangements and their covers or panels without the use of special tools and can be just as easily re-mounted.

6 Claims, 2 Drawing Figures

COVER ARRANGEMENT FOR COVERING THE BALUSTRADE SILL OF A TRANSPORTATION APPARATUS, SUCH AS AN ESCALATOR OR MOVING WALKWAY

BACKGROUND OF THE INVENTION

The present invention broadly relates to a new and improved cover arrangement for covering the balustrade socket or bed also referred to as a sill or base of a transport or transportation apparatus, such as an escalator or moving walk or walkway.

Generally speaking, the cover arrangement of the balustrade sill or base of the transportation apparatus, such as an escalator or a moving walkway, as contemplated by the present invention, comprise two mutually independent covers or panels, one of which constitutes a sill cover or panel—the so-called inner cover or panel—and the other of which constitutes the outer lining-side or cladding cover or panel—the so-called outer cover or panel. Each of these covers or panels are arranged on one or the other respective side of a substantially vertically standing or disposed or upright balustrade carrier or support and are manufactured from brake-formed or bent-over sheet metal and/or drawn profiles or structural elements.

In escalators and moving walkways in common use today and equipped with self-supporting balustrades, preferably formed of hardened glass, there are required covers or cover arrangements for the balustrade sill or base both on the side of such sill or base and on the outer side facing the escalator or moving walkway. During the course of performing maintenance work, occasional access to the inside of the balustrade base is required, for which purpose portions or sections of the cover arrangement must be removed. Consequently, it is important to pay special attention to the fixing or attachment of the components or parts of the cover arrangements.

For the covering of balustrade sill or base constructions, there have already been proposed the use of drawn profiles with spring-catch or snap arrangements which possess no visible screws or bolts and which can be removed and replaced without the need to use special tools and without much expenditure in work. The installations for the mounting of these profiles are, however, very complicated and the profiles were not capable of providing any satisfactory results because of their internal or inherent stresses produced by virtue of the prior deformation or shaping work undertaken at such profiles. The same unsatisfactory results existed in the case of screwed or bolted covering profiles in which the visible screw or bolt heads were covered by additional clamping profiles. From U.S. Pat. No. 3,991,877, granted Nov. 16, 1976, an escalator has become known in the art, in which, among other things, there is also disclosed a cover arrangement for the balustrade sill or base. A glass balustrade is held in a longitudinal slot of a clamping support or holder embracing the lower balustrade end. The clamping support or holder is clamped together with the base of the balustrade in a number of screw clamps which are fixed to the frame construction of the escalator or moving stairway. At the top, free end of the clamping support or holder there are provided on both sides, towards the sill or base and towards the outer side, horizontally arranged, longitudinal slots for the reception of the cover arrangement of the balustrade sill. On the side of the outer cover or panel, a tongue or flap of a drawn profile rests in a longitudinal slot which, at the same time, engages the top edges of the outer lining or paneling plates. This covering profile is clamped to the frame construction of the escalator by means of a dovetail-type fastening arrangement which is only accessible from the inside. On the other or sill side, the one longitudinal edge of an inserted brake-formed or bent-over metal cover or panel sheet rests in the other longitudinal slot. This cover or panel sheet, on the other longitudinal edge thereof, is bolted to the sill or base which is fixed to the frame construction, by means of a number of screws or bolts arranged to be recessed or sunk into a longitudinal groove provided with a bent edge.

A disadvantage of this balustrade covering or cover arrangement resides in the fact that the outer cover or panel cannot be removed by itself, but only in conjunction with the sill cover or panel, and that the sill cover or panel, despite the provision of the longitudinal groove containing the bent edge, displays visible screw or bolt heads. Additionally, the screws or bolts arranged in the region of the belt or band carrying the steps of the transportation apparatus, notwithstanding the fact that the screw or bolt heads are sunk into the longitudinal groove, present a certain safety hazard.

SUMMARY OF THE INVENTION

Therefore, with the foregoing in mind, it is a primary object of the present invention to provide a new and improved construction of a cover arrangement for the balustrade sill or base of a transportation apparatus, such as an escalator or moving walkway, which does not exhibit the aforementioned drawbacks and shortcomings of the prior art constructions.

A further important object of the present invention aims at providing a new and improved and economical construction of a cover arrangement for a balustrade sill or base of a transportation apparatus, such as an escalator or moving walkway, which possesses no visible fixation or attachment means, which can be elastically fitted or mounted, and wherein each side of the cover arrangement can be disassembled and reassembled in the simplest manner independently of the other side and without the need to use special tools.

Yet a further significant object of the present invention is to provide a new and improved construction of a cover arrangement for a transportation apparatus, such as an escalator or moving walkway, wherein such cover arrangement is economical to fabricate and mount and dismantle at the transportation apparatus, provides an attractive covering for the balustrade sill or base devoid of visible screw or bolt heads or other appropriate fixation expedients, and with the possibility of easily dismantling and remounting individual covers or panels independently of one another.

Now in order to implement these and still further objects of the invention, which will become more readily apparent as the description proceeds, the cover arrangement for the sill or base of the transportation apparatus, such as an escalator or moving walkway, is manifested by the features that at least one retention or holder element, composed of two mutually adherent, separable or disconnectable individual parts or components, is provided between the inner cover or panel or the outer cover or panel and the bottom or sub-structure of the balustrade sill or base. The first part or component of the retention or holder element is arranged at the bottom or sub-structure of the balustrade sill or base, and the second part or component of such retention or holder element is arranged at the inner side or surface of the associated cover or panel.

The advantages attained with the present invention essentially reside in the fact that for the cover arrangement there can be beneficially utilized bent sheeting or plating, i.e. sheet metal, of any desired material or any desired surface properties without welding being required, that no screw or bolt heads are visible, and no additional profiles or structural elements are necessary for covering screw or bolts heads.

A further advantage of the present invention lies in the fact that the paired retention or holder elements arranged at the rear of the related cover or panel and upon the bottom or sub-structure of the balustrade sill or base, permit an elastic fixing or a resilient fixation of the cover arrangement and allow for a certain inexactness during the fixation of these retention or holder elements, without thereby impairing the exact position of the cover arrangement which is to be fixed or attached.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
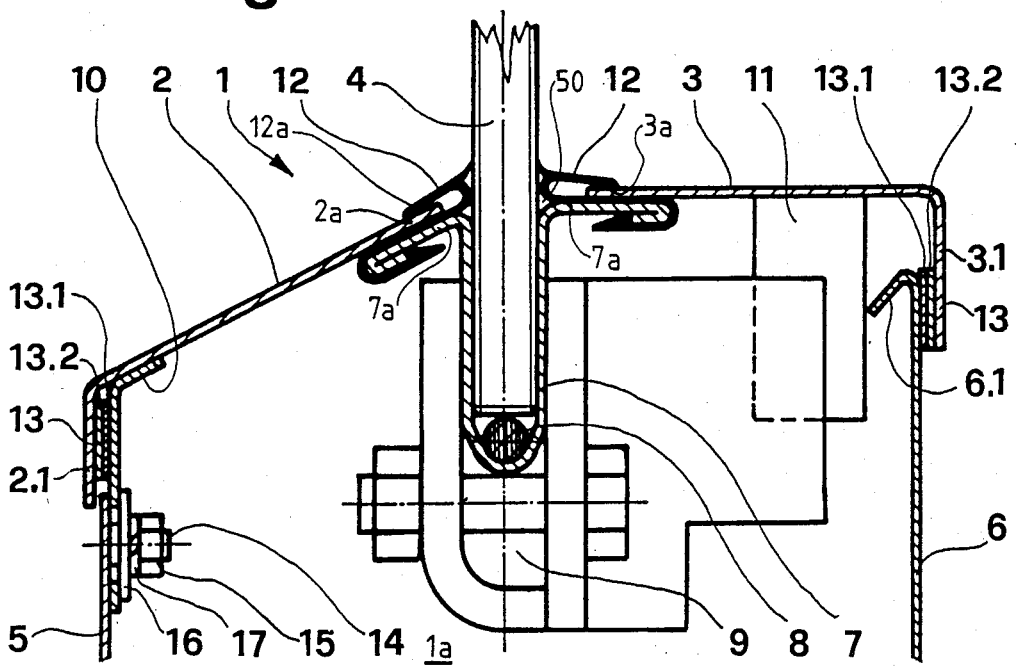
FIG. 1 illustrates a sectional view through a balustrade sill or base of a transportation apparatus, here shown as an escalator, but which may also be a moving walkway, equipped with vertically arranged retention or holder elements.

Describing now the drawings, it is to be understood that to simplify the showing thereof, only enough of the structure of the covering or cover arrangement for the balustrade sill or base of a transportation apparatus, such as an escalator or moving walkway, has been illustrated therein as is needed to enable one skilled in the art to readily understand the underlying principles and concepts of the present invention. Turning now specifically to FIG. 1 of the drawings, the exemplary embodiment of covering or cover arrangement for a balustrade sill or base, will be seen in relation to an escalator or moving walkway balustrade sill or base 1. The balustrade sill or base 1, which includes a bottom or sub-structure generally indicated by reference character 1*a*, is enclosed towards the top by means of a sill or base cover or panel 2, the so-called inner cover or panel, and an outer lining-side or facing cover or panel 3, the so-called outer cover or panel. Between the inner cover or panel 2 and the outer cover or panel 3, there is arranged a substantially vertical or upright balustrade carrier or support 4. This balustrade carrier or support 4 rests in a clamping profile or member 7 on, for instance, a circular or round cord 8 or the like made of rubber or similar material, and such balustrade carrier or support 4 together with the clamping profile 7 is secured or retained by a clamping device 9.

The clamping device 9 is appropriately fixedly connected with the bottom structure or sub-structure 1*a* of the balustrade sill or base 1. Between the inner cover or panel 2 and the balustrade carrier or support 4 and equally between the outer cover or panel 3 and such balustrade carrier or support 4, there is arranged a respective plastic cover profile or element 12. Each such plastic cover or closure profile or element 12 is fixed to a respective leg or leg member 7*a* of the clamping profile or element 7. Furthermore, each such plastic cover profile or element 12, on the one hand, engages about an inner edge 2*a* or 3*a* of the related cover or panel 2 or 3, as the case may be, and, on the other hand, elastically seals the associated gap or space 50 neighboring the balustrade carrier or support 4.

A supporting plate 11 fixed to the clamping device 9 supports the outer cover or panel 3 and the angled or bent top or upper edge 6.1 of a plate of an outer lining or skirt 6 of the bottom or sub-structure 1*a* of the sill or base 1. Between the outer lining or skirt 6 and a bent-over leg 3.1 of the outer cover or panel 3, there is arranged a retention or holder element 13 consisting of two conventional mutually adherent, separable, self-adhesive or self-adhering interlocking or gripping strips or bands 13.1 and 13.2. Such interlocking strips or bands 13.1 and 13.2 may be constituted by standard "Velcro-type" fasteners having interlocking or engaging hooks and loops or the like, and which are provided at the opposite face of each such strip or band with a self-adhesive or self-adhering surface. The first interlocking or gripping strip 13.1 of the two separable, mutually coacting interlocking strips 13.1 and 13.2 of the retention or holder element 13 and which strips define at their confronting surfaces or interface a fastening or adherent surface, is fixed to the outer lining or skirt 6 and the second interlocking or gripping strip 13.2 of these two separable, mutually coacting interlocking strips 13.1 and 13.2 is fixed to the inner side of the leg 3.1 of the associated outer cover or panel 3.

A support profile or element 10, adjustably fixedly bolted to a skirt 5 of the sub-structure 1*a* by means of a welded stud 14, a washer 15, a spring ring or washer 17 and a nut 15, supports the inner cover or panel 2. Between the support profile 10 and a leg 2.1 of the inner cover or panel 2, there is likewise arranged a retention or holder element 13 again consisting of two mutually adherent or coacting, separable, self-adhesive or self-adhering interlocking or gripping strips or bands 13.1 and 13.2. The first interlocking or gripping strip 13.1 of the two separable, self-adhesive interlocking or gripping strips 13.1 and 13.2 of the retention or holder element 13 is fixed to the support profile 10, and the second interlocking or gripping strip 13.2 of these two separable, self-adhesive interlocking or gripping strips 13.1 and 13.2 is fixed to the inner side of the leg 2.1 of the associated inner cover or panel 2.

Figure 2:
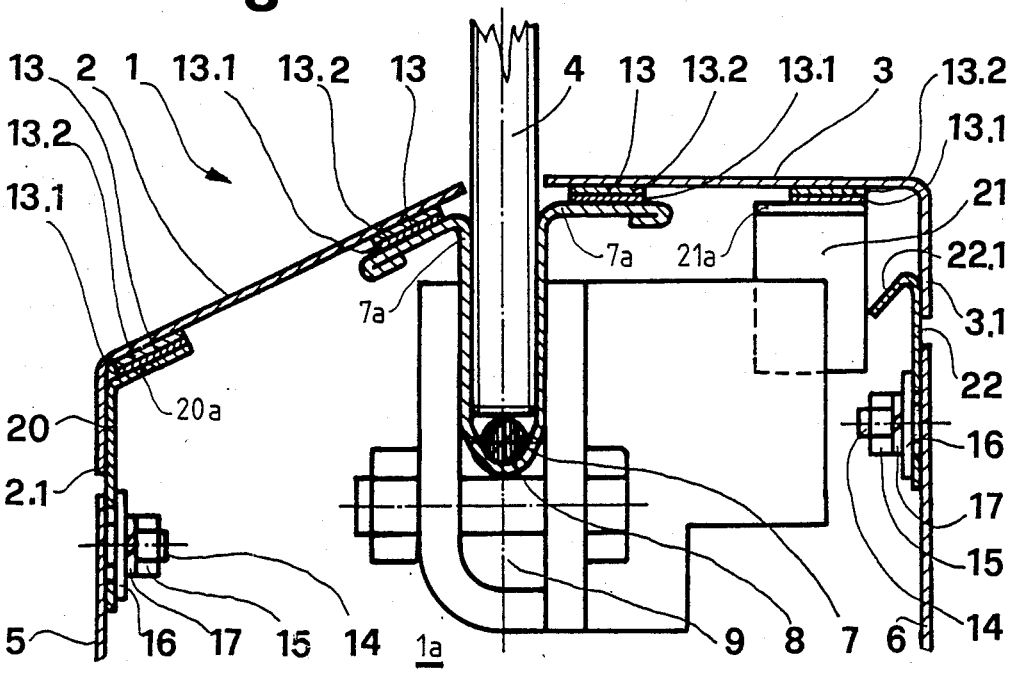
FIG. 2 illustrates a sectional view of a further exemplary embodiment of a balustrade sill or base of a transportation apparatus, here again shown as an escalator, but which likewise may be a moving walkway, equipped with retention or holder elements positioned substantially parallel to the surface of the cover arrangement.

In the modified construction depicted in FIG. 2, the balustrade sill or base of the transportation apparatus, here likewise, for instance, an escalator or moving walkway, is again conveniently indicated by reference numeral 1. This balustrade sill or base 1 is closed at the top by means of the inner cover or panel 2 and the outer cover or panel 3 of the cover arrangement 2, 3. The balustrade carrier or support 4 is positioned between the inner cover or panel 2 and the outer cover or panel 3. This balustrade carrier 4 rests in the clamping profile or element 7 upon the, for instance, circular or round cord 8, made of rubber or similar material, and together with the clamping profile 7 is retained by the clamping device 9. The clamping device 9 is also connected with the bottom or sub-structure 1*a* of the balustrade sill or base 1.

The outer cover or panel 3 snugly bears by means of its bent-over or angled leg 3.1 against a distance or spacer plate 22 of the outer skirt or plate 6 and at the other or opposite side merges with the smallest amount of play at the balustrade carrier or support 4. The distance or spacer plate 22 is fixedly threaded or bolted to the related outer skirt or plate 6 by means of welded bolts or studs 14 arranged on the outer skirt or plate 6, the washers 16, the spring or lock washers 17 and the nuts 15. In this manner, the outer skirts or plates 6 are fixed by means of the angled or bent edge 22.1 of the distance or spacer plate 22 which is clampingly held between the brake-formed or bent-over leg 3.1 of the associated outer cover or panel 3 and the support plate 21.

Between the outer cover or panel 3 and a leg 7*a* of the clamping profile or element 7 and between such outer cover or panel 3 and a leg 21*a* of the support plate 21 there are arranged a respective one of two retention or holder elements 13, each again consisting of two mutually adherent and coacting, separable, self-adhesive or self-adhering interlocking or gripping strips or bands 13.1 and 13.2. The first respective interlocking or gripping strip 13.1 of each of the two retention or holder elements 13, is fixed to the associated leg 7*a* and 21*a* of the clamping profile or element 7 and the support plate 21, respectively, and each respective second interlocking or gripping strip 13.2 of the two retention or holder elements 13 is fixed on the inner side of the associated outer cover or panel 3. The inner cover or panel 2 lies with its leg 2.1 fitting snugly against the sill or base plate 5 and likewise merges with the smallest amount of play at the balustrade carrier or support 4.

Between the inner cover or panel 2 and a leg 7*a* of the clamping profile or element 7 and between such inner cover or panel 2 and a leg 20*a* of a support profile 20 adjustably bolted to the sill or base plate 5 by means of a welded stud 14, a washer 16, a spring or lock washer 17 and a nut 15, there are again arranged a respective one of two retention or holder elements 13 likewise consisting of two mutually adherent and coacting, separable, self-adhesive or self-adhering interlocking or gripping strips or bands 13.1 and 13.2. Each respective first interlocking or gripping strip 13.1 of the two retention or holder elements 13 is fixed to the respective leg 7*a* and 20*a* of the clamping profile or element 7 and the support profile 20, respectively, and each of the second interlocking or gripping strips 13.2 of the two retention or holder elements 13 is fixed on the inside of the associated inner cover or panel 2.

The two independent covers or panels 2 and 3 according to the arrangement of FIG. 1 are, in principle, installed in the same way when they are fitted upon the balustrade sill or base 1. The inner cover or panel 2 and the outer cover or panel 3 are each, on the one hand, laid with their rear edge 2*a* and 3*a*, respectively, onto the related closing or closure profile 12, for instance formed of polyvinylchloride (PVC), of the clamping profile or element 7 and on the other hand placed onto the support profile 10 and the support plate 11, respectively. Thereafter these covers or panels 2 and 3 are pushed towards the balustrade carrier or support 4 without lifting them off the two supports 12, 10 respectively, 12, 11, until the two mutually coacting interlocking or gripping strips 13.1 and 13.2 of the retention elements 13 grip each other tightly or firmly interlock. So that the respective rear ends 2*a* and 3*a* of the inner cover or panel 2 and the outer cover or panel 3 may be more easily inserted or pushed into the PVC closure profile or element 12, a thin auxiliary foil possessing a low coefficient or friction may be placed between the tongues or tabs 12*a* of the PVC closure profiles or elements 12 and the edge of the associated inner cover or panel 2, respectively the outer cover or panel 3, or a locally upset or bent-up tongue or flap of the PVC closure profile 12 can subsequently, with the aid of a screwdriver or other suitable tool, be led around the related edge of the cover arrangement 2,3.

Upon mounting a second neighboring cover arrangement section or portion likewise composed of an inner cover or panel 2 and an outer cover or panel 3, the front edges can be slid snugly together so that a clean abutment or joint exists.

For the removal of the cover arrangement 2,3 composed of the inner cover or panel 2 and the outer cover or panel 3 from the balustrade socket or bed 1, two screw drivers or other suitable implements or tools are inserted between the legs 2.1 and 3.1 of the cover arrangement 2,3 and the socket plate or skirt 5 and the outer skirt 6, respectively, and the cover arrangement 2,3 is removed from the balustrade sill or base 1 by means of a lever effect.

The fixing or attachment of the two covers 2 and 3, namely the inner cover or panel 2 and the outer cover or panel 3, in accordance with the modified construction of FIG. 2, follows a similar attachment pattern or sequence of manipulations or operations. The cover arrangement 2,3 compose of the inner cover or panel 2 and the outer cover or panel 3, is held essentially parallel to the related supports and a few centimeters over them with their rear edges bearing against the balustrade carrier or support 4 and then these covers or panels 2 and 3 are moved vertically downwards along the balustrade carrier or support 4. Shortly after the tongues or flaps 2.1 and 3.1 of the cover arrangement 2,3 slide over the vertical portion of the support profile 20 and the vertical portion of the distance of spacer plate 22, the two interlocking or gripping strips or bands 13.1 and 13.2 of the retention or holder elements 13, mutually interlock or lockingly engage with each other and fasten themselves and hold the cover arrangement 2,3 firmly in place. With this exemplary embodiment, no closure profiles for the balustrade carrier or support 4 are required, but, on the other hand, clean joints are more difficult to achieve and the disassembly work for the inner cover or panel 2 and the outer cover or panel 3 is more complicated than for the variant embodiment according to FIG. 1.

While there are shown and described present preferred embodiments of the invention, it is to be distinctly understood that the invention is not limited thereto, but may be otherwise variously embodied and practiced within the scope of the following claims.

Accordingly, what we claim is:

1. A cover arrangement for covering a balustrade sill having a sub-structure of a transportation apparatus, such as an escalator or moving walkway, comprising:

a substantially upright balustrade carrier having opposite sides;

an inner cover and an outer cover independent of said inner cover;

each of said inner and outer cover being arranged at a respective one of said opposite sides of said substantially upright balustrade carrier;

at least one retention element arranged between an associated cover of said inner and outer covers and the sub-structure of the balustrade sill;

said at least one retention element comprising two mutually adherent, separable individual parts defining a first retention part and a second retention part;

said first retention part of said at least one retention element being arranged at the sub-structure of the balustrade sill and said second retention part of said at least one retention element being arranged at an inner side of said associated cover; and said first and second retention parts of said at least one retention element each comprising respective self-adhesive interlocking strips.

2. The cover arrangement as defined in claim 1, wherein:

said inner and outer covers are formed of drawn profile members.

3. The cover arrangement as defined in claim 1, wherein:

said inner and outer covers are formed of formed sheet metal.

4. The cover arrangement as defined in claim 1, wherein:

each cover of said inner and outer covers is provided with a respective leg; and said retention element has an adhesive surface arranged substantially parallel to said respective leg of said associated cover.

5. The cover arrangement as defined in claim 1, wherein:

each cover of said inner and outer covers is provided with an upper surface; and said retention element having an adhesive surface arranged substantially parallel to said upper surface of said associated cover.

6. The cover arrangement as defined in claim 4, wherein:

each said cover has an edge located opposite said leg thereof;

each said cover forming by means of said edge a respective gap relative to said balustrade carrier; and a respective plastic closure profile for obturating said gap.

* * * * *